US011401014B2

(12) United States Patent
Reddy et al.

(10) Patent No.: US 11,401,014 B2
(45) Date of Patent: Aug. 2, 2022

(54) TANGENT SUPPORT TUBE FOR LIFE RAFT ASSEMBLIES

(71) Applicant: Goodrich Corporation, Charlotte, NC (US)

(72) Inventors: Chana Kesava Reddy, Hyderabad (IN); Bhavamanyu Aman Saxena, Lucknow (IN)

(73) Assignee: Goodrich Corporation, Charlotte, NC (US)

( * ) Notice: Subject to any disclaimer, the term of this patent is extended or adjusted under 35 U.S.C. 154(b) by 7 days.

(21) Appl. No.: 16/943,531

(22) Filed: Jul. 30, 2020

(65) Prior Publication Data

US 2021/0291946 A1 Sep. 23, 2021

(30) Foreign Application Priority Data

Mar. 20, 2020 (IN) ..... 202041012144

(51) Int. Cl.
*B63C 9/04* (2006.01)
*B63B 73/43* (2020.01)
*B60C 29/00* (2006.01)

(52) U.S. Cl.
CPC ..... *B63C 9/04* (2013.01); *B63B 73/43* (2020.01); *B63C 9/24* (2013.01); *B63C 2009/042* (2013.01)

(58) Field of Classification Search
CPC .... B63C 9/00; B63C 9/04; B63C 9/24; B63C 2009/042; B63C 2009/044; B63C 2009/046; B63B 73/43
USPC ..... 441/38, 40, 41, 42, 44
See application file for complete search history.

(56) References Cited

U.S. PATENT DOCUMENTS 3,054,124 A * 9/1962 Silverstone ..... B63C 9/02 441/40
4,127,909 A * 12/1978 Pizzo ..... B63C 9/04 441/40
4,678,443 A 7/1987 Edwards et al.
5,922,156 A * 7/1999 Merchant ..... B63B 7/08 441/40
5,927,228 A 7/1999 Richard et al.
6,209,150 B1 * 4/2001 Hsu ..... E04H 4/0025 4/499
6,581,334 B2 * 6/2003 Oney ..... B64D 25/14 138/120
6,749,474 B2 6/2004 Hsu et al.
10,322,781 B1 6/2019 Haynes et al.
10,351,219 B1 7/2019 Haynes et al.

FOREIGN PATENT DOCUMENTS

GB 2030079 4/1980

* cited by examiner

*Primary Examiner* — Lars A Olson
(74) *Attorney, Agent, or Firm* — Snell & Wilmer L.L.P.

(57) ABSTRACT

A life raft may comprise a border tube and a canopy support tube coupled to an outer portion of the border tube. A first orifice defined by the canopy support tube is aligned with a second orifice defined by the border tube. A diameter of the first orifice is less than a diameter of the second orifice.

18 Claims, 9 Drawing Sheets

TANGENT SUPPORT TUBE FOR LIFE RAFT ASSEMBLIES

CROSS REFERENCE TO RELATED APPLICATIONS

This application claims priority to and the benefit of India Patent Application No. 202041012144 filed on Mar. 20, 2020 and entitled "TANGENT SUPPORT TUBE FOR LIFE RAFT ASSEMBLIES," which is hereby incorporated by reference in its entirety for all purposes.

FIELD

The present disclosure relates to inflatable assemblies and, in particular, to life raft assemblies having a tangent support tube.

BACKGROUND

In the event of an emergency water landing, aircraft typically have one or more life rafts that can be deployed to hold evacuated passengers. To inflate the life raft, gas is transferred from a cylinder containing compressed gas. A canopy for providing shelter, after a water landing, may be included with the life raft, as set forth by various governmental agencies. The life raft may include canopy support tubes which are bonded to an upper surface of main inflatable life raft structure. Attaching the support tubes to the upper surface may include using an adhesive to bond flanges of the support to the upper surface of main inflatable structure.

SUMMARY

A life raft is disclosed herein. In accordance with various embodiments, the life raft may comprise a border tube and a canopy support tube coupled to an outer portion of the border tube. A first orifice defined by the canopy support tube may be aligned with a second orifice defined by the border tube. A diameter of the first orifice may be less than a diameter of the second orifice.

In various embodiments, an inner patch may be coupled to an inner circumferential surface of the border tube and an outer circumferential surface of the canopy support tube. In various embodiments, an outer dimeter of the inner patch may be greater than the diameter of the second orifice.

In various embodiments, a seam tape may be coupled to the outer circumferential surface of the canopy support tube and an outer circumferential surface of the border tube. In various embodiments, the outer portion of the border tube may be approximately 90° from an uppermost point of the border tube.

In various embodiments, a closed end of the canopy support tube may include a first portion of the outer circumferential surface of the canopy support tube bonded to a second portion of the outer circumferential surface of the canopy support tube. In various embodiments, the closed end of the canopy support tube may include a weld bonding the first portion of the outer circumferential surface of the canopy support tube to the second portion of the outer circumferential surface of the canopy support tube.

A life raft, in accordance with various embodiments, may comprise a first border tube, a second border tube located on the first border tube, and a canopy support tube coupled to an outer portion of at least one of the first border tube or the second border tube. A first orifice defined by the canopy support tube may be aligned with a second orifice defined by the at least one of the first border tube or the second border tube. A diameter of the first orifice may be less than a diameter of the second orifice.

In various embodiments, an inner patch may be coupled to an outer circumferential surface of the canopy support tube and to an inner circumferential surface of the at least one of the first border tube or the second border tube and. In various embodiments, an outer dimeter of the inner patch may be greater than the diameter of the second orifice.

In various embodiments, a seam tape may be coupled to the outer circumferential surface of the canopy support tube and an outer circumferential surface of the at least one of the first border tube or the second border tube. In various embodiments, a line tangent to the outer portion of the at least one of the first border tube or the second border tube may be approximately perpendicular to a line tangent to an uppermost point of the first border tube.

In various embodiments, a closed end of the canopy support tube may include a first portion of the outer circumferential surface of the canopy support tube bonded to a second portion of the outer circumferential surface of the canopy support tube.

In various embodiments, a one-way valve may be located between a first interior volume defined by the canopy support tube and a second interior volume defined by the at least one of the first border tube or the second border tube. In various embodiments, the one-way valve may be configured allow fluid to flow from the second interior volume to the first interior volume.

A method of forming a life raft is also disclosed herein. In accordance with various embodiments, the method may comprise aligning a canopy support tube orifice defined by a canopy support tube with a border tube orifice defined by a border tube, bonding an inner patch to an inner circumferential surface of the border tube, and bonding the inner patch to an outer circumferential surface of the canopy support tube.

In various embodiments, the method further may comprise closing an end of the canopy support tube using radio frequency welding. In various embodiments, closing the end of the canopy support tube using radio frequency welding may comprise applying a non-conductive tape to an inner circumferential surface of the canopy support tube, folding an edge of the canopy support tube into an interior volume of the canopy support tube, and generating an electric field at the end of the canopy support tube.

In various embodiments, a diameter of the canopy support tube orifice may be less than a diameter of the border tube orifice. In various embodiments, the border tube orifice may be located on an outer portion of the border tub. A line tangent to the outer portion of the border tube may be approximately perpendicular to a line tangent to an uppermost point of the border tube.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the exemplary embodiments of the disclosure, it should be understood that other embodiments may be realized and that logical changes and adaptations in design and construction may be made in accordance with this disclosure and the teachings herein. Thus, the detailed description herein is presented for purposes of illustration only and not limitation. The steps recited in any of the method or process descriptions may be executed in any order and are not necessarily limited to the order presented.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option.

Surface cross hatching lines may be used throughout the figures to denote different parts but not necessarily to denote the same or different materials. Throughout the present disclosure, like reference numbers denote like elements. Accordingly, elements with like element numbering may be shown in the figures, but may not necessarily be repeated herein for the sake of clarity.

In the context of the present disclosure, methods, systems, and articles may find particular use in connection with life raft assemblies. However, various aspects of the disclosed embodiments may be adapted for performance in a variety of other inflatable assemblies. As such, numerous applications of the present disclosure may be realized.

Figure 1A:
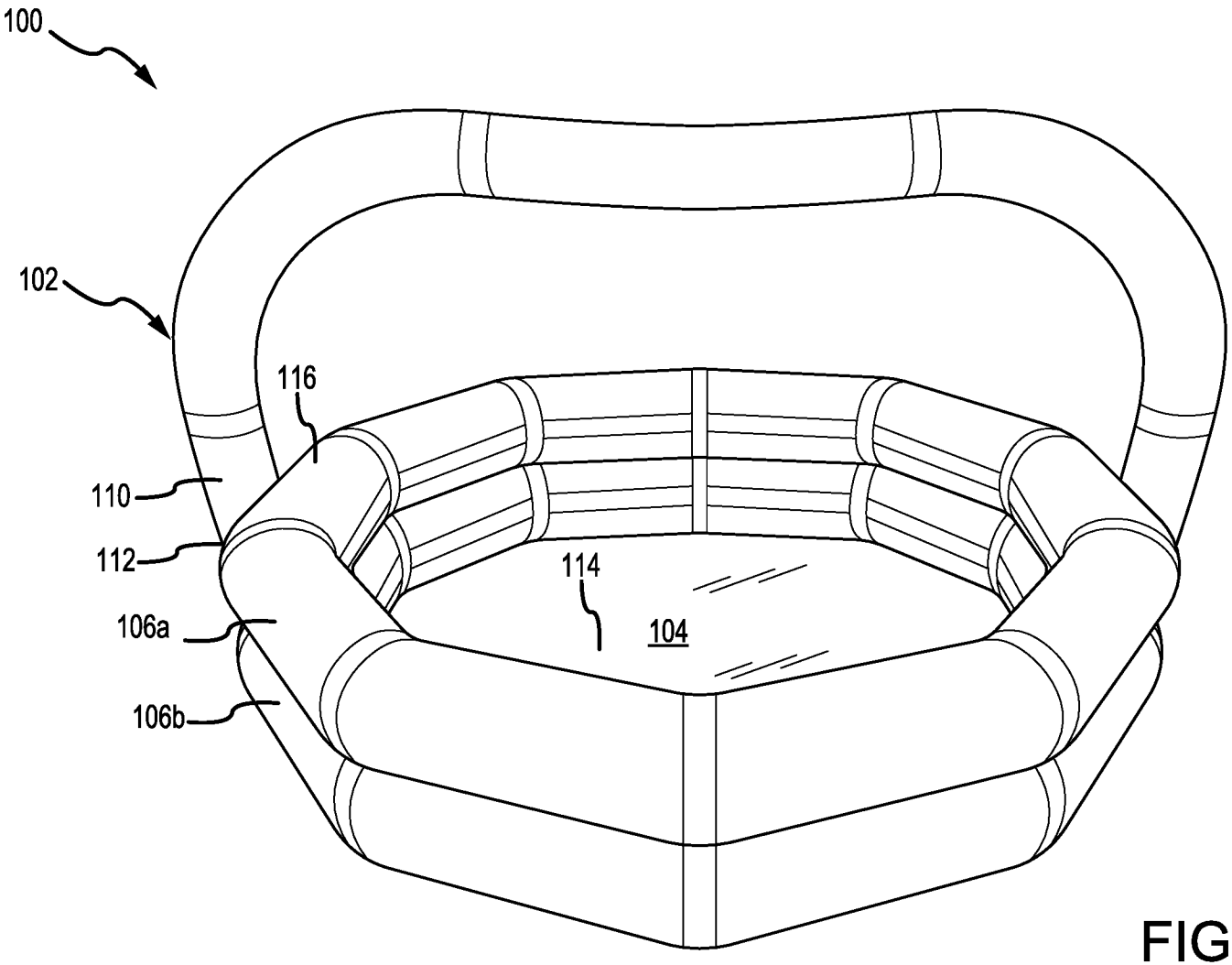
FIGS. 1A and 1B illustrate a life raft in an inflated state and having a canopy support tube attached at the outer perimeter of the life raft, in accordance with various embodiments.
Figure 1B:
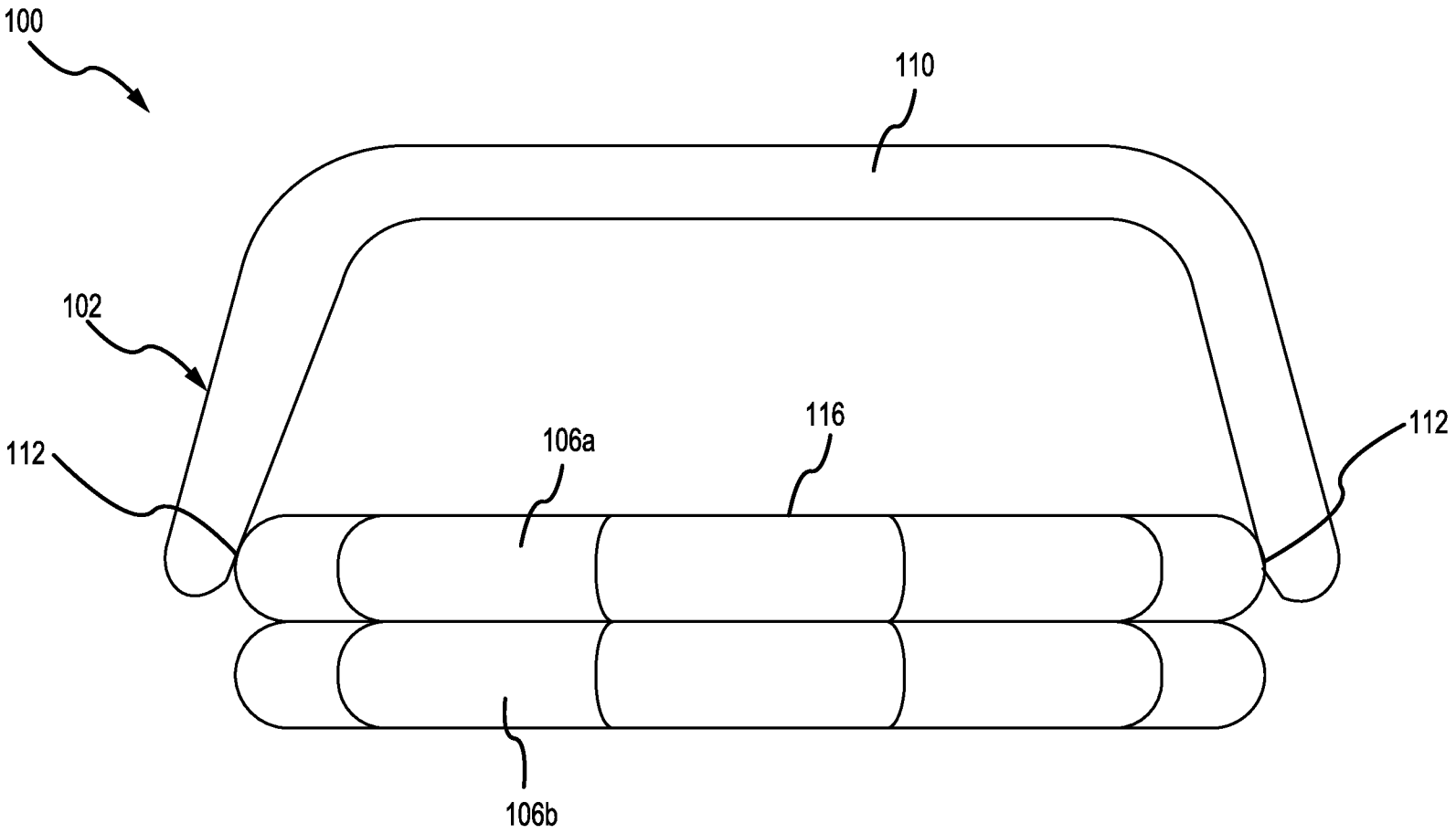

In accordance with various embodiments, and with reference to FIGS. 1A and 1B, a life raft 100 is illustrated in a deployed, or inflated, state. Life raft 100 includes an inflatable structure 102. Inflatable structure 102 may comprise a flexible, waterproof material such as a polyurethane polymer, polyvinylchloride polymer, or other suitable polymer. Inflatable structure 102 may comprise a base 104 configured to support passengers and separate passengers from a body of water while inflatable structure 102 is in operation. Inflatable structure 102 may include one or more inflatable border tubes 106*a*, 106*b*. Inflatable border tubes 106*a*, 106*b* may provide buoyancy to the inflatable structure 102 and may be mounted one on the other. Inflatable border tubes 106*a*, 106*b* may provide a degree of redundancy in that each border tube may be independently capable of supporting the weight of life raft 100 when filled to capacity with passengers. Inflatable border tubes 106*a*, 106*b* may circumscribe the base 104. In various embodiments, inflatable structure 102 may generally comprise a hexagonal shape. That is, inflatable border tube 106*a* and inflatable border tube 106*b* may define a hexagonal shape. However, inflatable structure 102 may generally comprise a circular shape, a rectangular shape, a pentagonal shape, an octagonal shape, or any other desired shape.

Inflatable structure 102 may further include a canopy support tube 110 (also referred to an outer tangent support tube). Canopy support tube 110 may be oriented as an arch extending between opposing sides of life raft 100. In accordance with various embodiments, canopy support tube 110 is fluidly coupled to border tube 106*a*. In this regard, border tube 106*a* and canopy support tube 110 may be part of one, interconnected chamber that fills with gas in response to deployment of life raft 100.

In accordance with various embodiments, canopy support tube 110 is attached to an outer portion 112 of border tube 106*a*. Outer portion 112 of border tube 106*a* is generally perpendicular to a first surface 114 of base 104 and/or to an uppermost point 116 of border tube 106*a*. Stated differently, a line tangent to outer portion 112 is approximately perpendicular to first surface 114 of base 104 and/or to a line tangent to uppermost point 116 of border tube 106*a*. As used in the previous context only, the term "approximately" means ±5°. First surface 114 of base 104 is oriented away from the water, when life raft 100 is in use. Uppermost point 116 of border tube 106*a* is oriented in the same direction as first surface 114. In various embodiments, canopy support tube 110 may be attached to border tube 106*a* at point that is approximately 90° about the circumference of the border tube 106*a* from uppermost point 116. As used in the previous context only, the term "approximately" means ±5°.

Figure 2A:
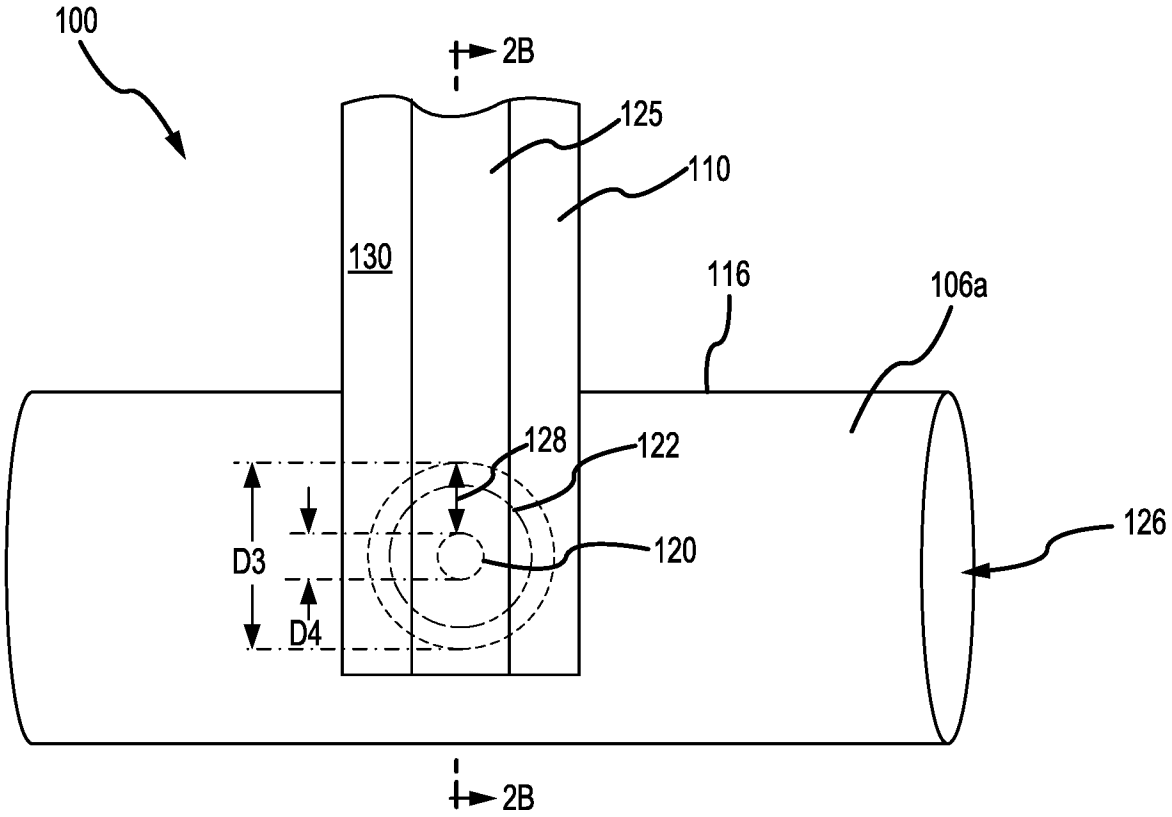
FIG. 2A illustrates a point of attachment between a canopy support tube and a border tube of a life raft, in accordance with various embodiments.
Figure 2B:
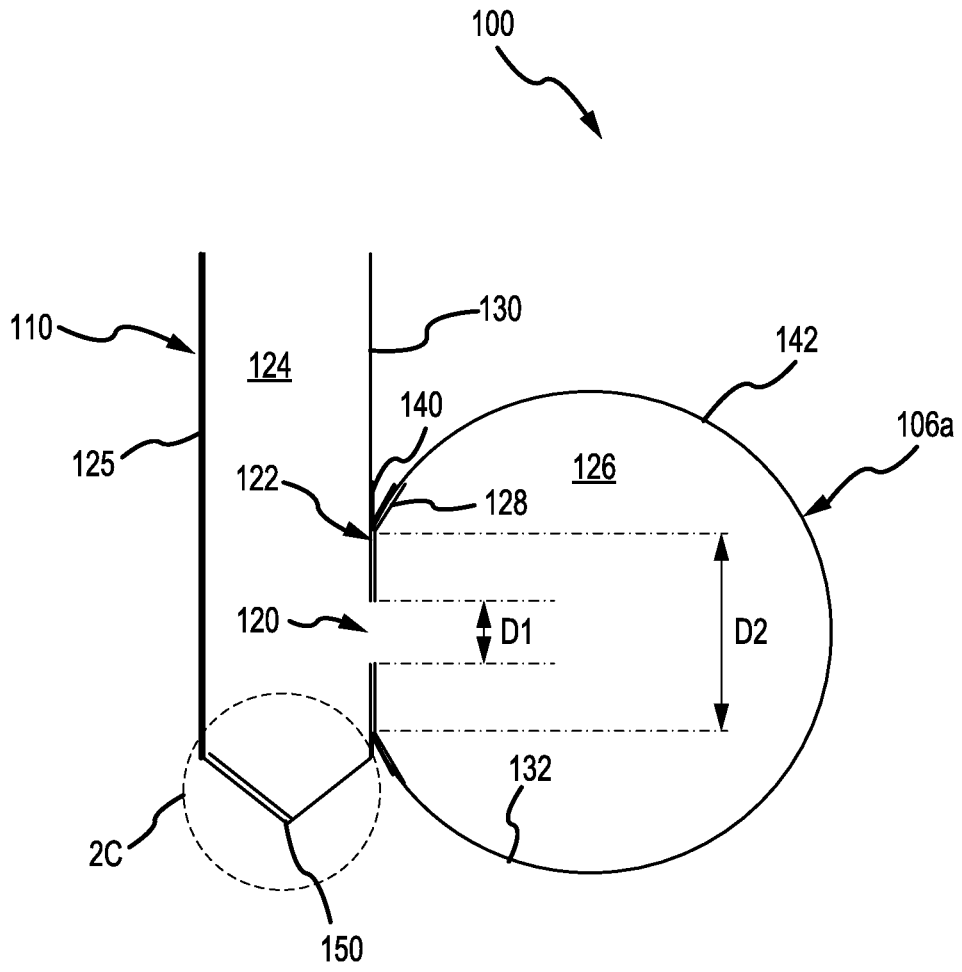
FIG. 2B illustrates a cross-section view of a point of attachment between an canopy support tube and a border tube of a life raft, taken along the line 2B-2B in FIG. 2A, in accordance with various embodiments.

With reference to FIGS. 2A and 2B, additional details of the attachment between canopy support tube 110 and border tube 106*a* are illustrated. In accordance with various embodiments, canopy support tube 110 defines an orifice 120 (also referred to as a support tube orifice) having a diameter D1. Border tube 106*a* defines an orifice 122 (also referred to as a border tube orifice) having a diameter D2. In accordance with various embodiments, diameter D2 is greater than diameter D1. In various embodiments, diameter D1 may be between 1 inch and 10 inches, 2 inches and 5 inches, and/or about 2 inches (2.5 cm and 25.4 cm, 5.1 cm and 12.7 cm, and/or about 5.1 cm). As used in the previous context only, the term "about" means ±0.5 inches (±. 1.3 cm). In various embodiments, diameter D2 may be between 2 inch and 20 inches, 4 inches and 10 inches, and/or about 4 inches (1.3 cm and 50.8 cm, 10.2 cm and 25.4 cm, and/or about 10.2 cm). As used in the previous context only, the term "about" means ±0.5 inches (±. 1.3 cm). In various embodiments, a ratio of diameter D2 to diameter D1 may be between 1.5:1 and 10:1, 2:1 and 5:1, and/or about 2:1.

In accordance with various embodiments, orifice 120 is aligned with orifice 122 such that orifices 120, 122 fluidly connect an interior volume 124 of canopy support tube 110 and an interior volume 126 of border tube 106*a*. In various embodiments, a seam tape 125 may be located along a butt seam, or butt joint, of canopy support tube 110. The butt seam is where two axially extending ends of canopy support tube 110 meet to form a generally cylindrically shaped tube. In this regard, seam tape 125 may extend axially along canopy support tube 110. In the previous context, the axial direction is parallel to an outer circumferential surface 130 of canopy support tube 110. In various embodiments, seam tape 125 and/or the butt seam of canopy support tube 110 may be oriented away from border tube 106*a*. In this regard, seam tape 125 and/or the butt seam of canopy support tube 110 may be 180° about the outer circumference of canopy support tube 110 from orifice 120.

In accordance with various embodiments, an inner patch 128 may be bonded to an outer circumferential surface 130 of canopy support tube 110 and an inner circumferential surface 132 of border tube 106*a*. Inner patch 128 may bonded to outer circumferential surface 130 of canopy support tube 110 and inner circumferential surface 132 of border tube 106*a* via adhesive, radio frequency welding, or any other suitable method.

In various embodiments, inner patch 128 may be an annular-shaped patch, having an outer diameter D3 and an inner diameter D4. Diameter D4 may be approximately equal to diameter D1 of orifice 120 in canopy support tube 110. As used in the previous context only, the term "about" means ±0.5 inches (±. 1.3 cm). Outer diameter D3 is greater than diameter D2 of orifice 122 in border tube 106*a*. In various embodiments, diameter D3 of inner patch may be between 0.50 inches and 20 inches greater than diameter D2, between 1 inches and 10 inches greater than diameter D2, between 2 inches and 5 inches greater than diameter D2, and/or about 2 inches greater than diameter D2. As used in the previous context only, the term "about" means ±0.5 inches (±. 1.3 cm). In various embodiments, embodiments, a ratio of diameter D3 to diameter D2 may be between 1.5:1 and 10:1, 2:1 and 5:1, and/or about 3:2.

Coupling inner patch 128 to inner circumferential surface 132 of border tube 106*a* and outer circumferential surface 130 of canopy support tube 110 may increase bonding strength between inner patch 128 and inner circumferential surface 132 of border tube 106*a* and between inner patch 128 and outer circumferential surface 130 of canopy support tube 110, as the non-bonded side of inner patch 128 is the non-fluid retentive side. Stated differently, bonding the fluid retentive side of inner patch 128 to inner circumferential surface 132 and outer circumferential surface 130 may decrease occurrences of separation between inner patch 128 and inner circumferential surface 132 and between inner patch 128 and outer circumferential surface 130. For example, the internal pressure within interior volume 126 applies a force against inner patch 128, thereby forcing inner patch 128 toward inner circumferential surface 132 of border tube 106*a* and outer circumferential surface 130 of canopy support tube 110.

In various embodiments, a seam tape 140 may be located between the outer circumferential surface 130 of canopy support tube 110 and an outer circumferential surface 142 of border tube 106*a*. seal tape may surround (may be located 360° about) orifice 122 in border tube 106*a*. Seam tape 140 may reinforce the coupling of canopy support tube 110 to border tube 106*a* and/or reduce leakage. In various embodiments, closed end 150 of canopy support tube 110 may be formed using radio frequency welding.

Figure 2C:
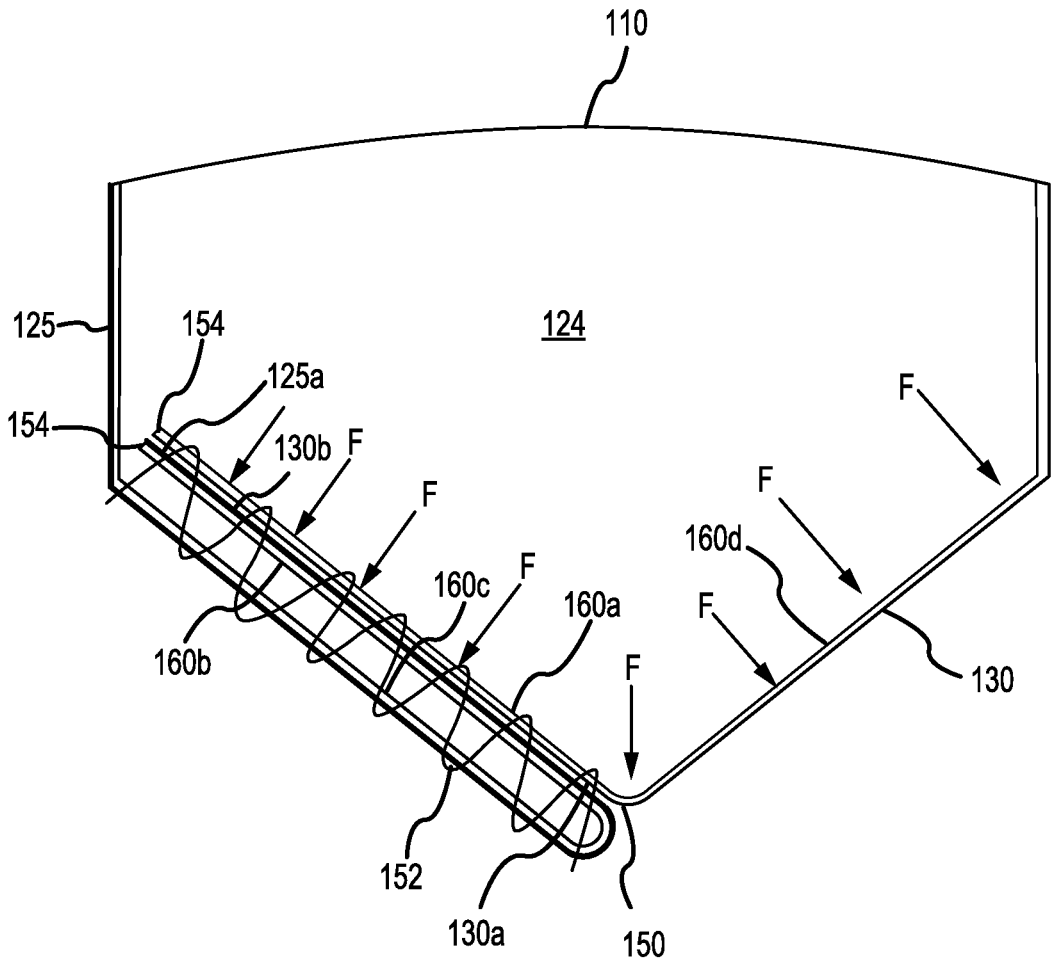
FIG. 2C illustrates a closed end of an canopy support tube, in accordance with various embodiments.

FIG. 2C illustrates additional details of closed end 150 of canopy support tube 110. In accordance with various embodiments, a weld, or bond, 152 may secure closed end 150. In various embodiments, the edge 154 of canopy support tube 110 is folded into interior volume 124 prior to performing the radio frequency weld. In this regard, a first portion 130*a* of the outer circumferential surface 130 is bonded to a second portion 130*b* of the outer circumferential surface 130. In various embodiments, a portion 125*a* of seam tape 125 may be located along portion 130*a* of the outer circumferential surface 130. Closed end 150 may exhibit a decreased probability for leakage, as the internal pressure and fluid F (e.g., air) within interior volume 124 applies a force to the inner circumferential surface 160 at closed end 150, thereby strengthening the bond at closed end 150 by forcing portion 130*a* toward portion 130*b*.

Figure 3A:
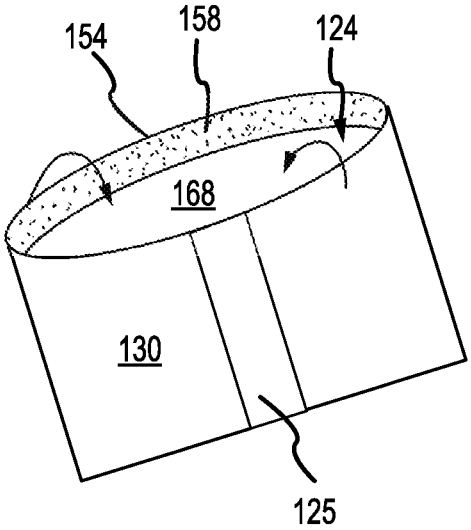
FIGS. 3A and 3B illustrate forming the closed end of the canopy support tube in FIG. 2C using radio frequency welding, in accordance with various embodiments.
Figure 3B:
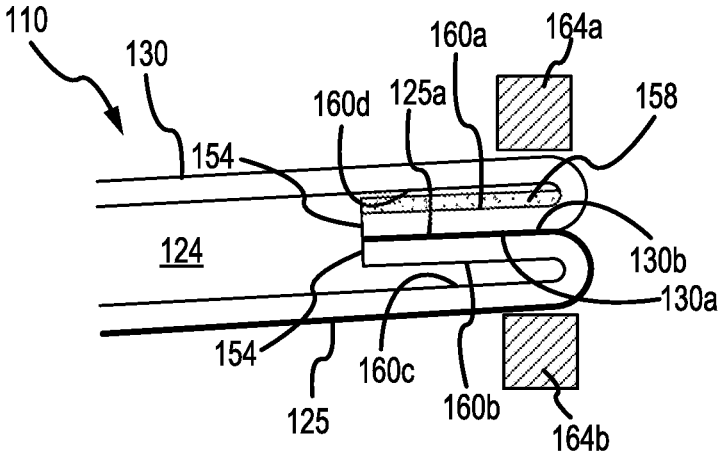

FIGS. 3A, 3B, and 3C illustrate formation of closed end 150, in accordance with various embodiments. With reference to FIG. 3A, a non-conductive tape 158 is located along 180° of the inner circumferential surface 160 of canopy support tube 110. Non-conductive tape 158 extends to edge 154 of canopy support tube 110. Edge 154 is then folded into interior volume 124 such that portion 130*a* of outer circumferential surface 130 is oriented toward portion 130*b* of outer circumferential surface 130. In various embodiments, portion 125*a* of seam tape 125 may be located along portion 130*a* of the outer circumferential surface 130, such that when edge 154 is folded into interior volume 124, portion 125*a* of seam tape 125 is also oriented toward portion 130*b* of outer circumferential surface 130. Portions 130*a* and 130*b* may each extend 180° about outer circumferential surface 130. Portion 130*a* may coincide (i.e., is aligned) with non-conductive tape 158. Stated differently, portion 130*a* and non-conductive tape 158 may extend around a first half of the circumference of canopy support tube 110 and portion 130*b* may extend around the other half of the circumference of canopy support tube 110.

With reference to FIG. 3B, the folded portion of canopy support tube 110 is located between electrodes 164*a* 164*b*. An electric field is applied to the folded portion of canopy support tube 110 by electrodes 164*a*, 164*b*. Portion 130*a* is forced against portion 130*b*. In various embodiments, portion 130*a* may be clamped to portion 130*b*. The portion 160*b* of inner circumferential surface 160 that coincides (i.e. is aligned) with portion 130*b* of outer circumferential surface 130 is pressed against portion 160*c* of inner circumferential surface 160. The portion 160*a* of inner circumferential surface 160 that coincides (i.e. is aligned) with portion 130*a* of outer circumferential surface 130 is pressed toward portion 160*d* of inner circumferential surface 160. Non-conductive tape 158 is located along portion 160*a* of inner circumferential surface 160. Non-conductive tape 158 masks and/or blocks a bond from forming between portion 160*a* and portion 160*d* of inner circumferential surface 160.

Returning to FIG. 2C, after the radio frequency wielding process is completed, weld 152 connects portion 130*a* of outer circumferential surface 130, portion 130*b* of outer circumferential surface 130, portion 160*a* of inner circumferential surface 160, portion 160*b* of inner circumferential surface 160, and portion 160*c* of inner circumferential surface 160. In various embodiments, portion 125*a* of seam tape 125 may be included in weld 152. Portion 160*d* of inner circumferential surface 160 remains unwelded and can translates away from portion 160*a* of inner circumferential surface 160. Portions 160*a* and 160*d* may form the gas retentive surface of interior volume 124 at closed end 150.

Figure 4:
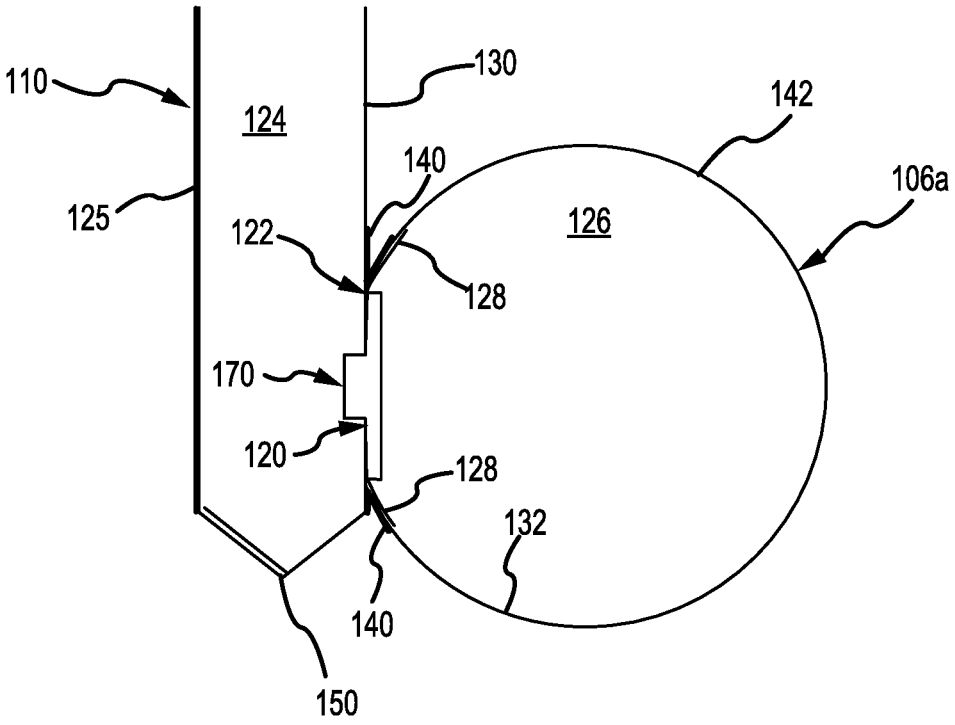
FIG. 4 illustrates a cross-section view of a one-way valve located at the point of attachment between an canopy support tube and a border tube of a life raft, in accordance with various embodiments.

With reference to FIG. 4, in various embodiments, a one-way valve 170 may be located between interior volume 124 and interior volume 126. One-way valve 170 may be located in orifice 120. One-way valve 170 may permit fluidly to flow from interior volume 126 to interior volume 124. One-way valve 170 may block or limit the flow of fluid from interior volume 124 to interior volume 126.

Figure 5A:
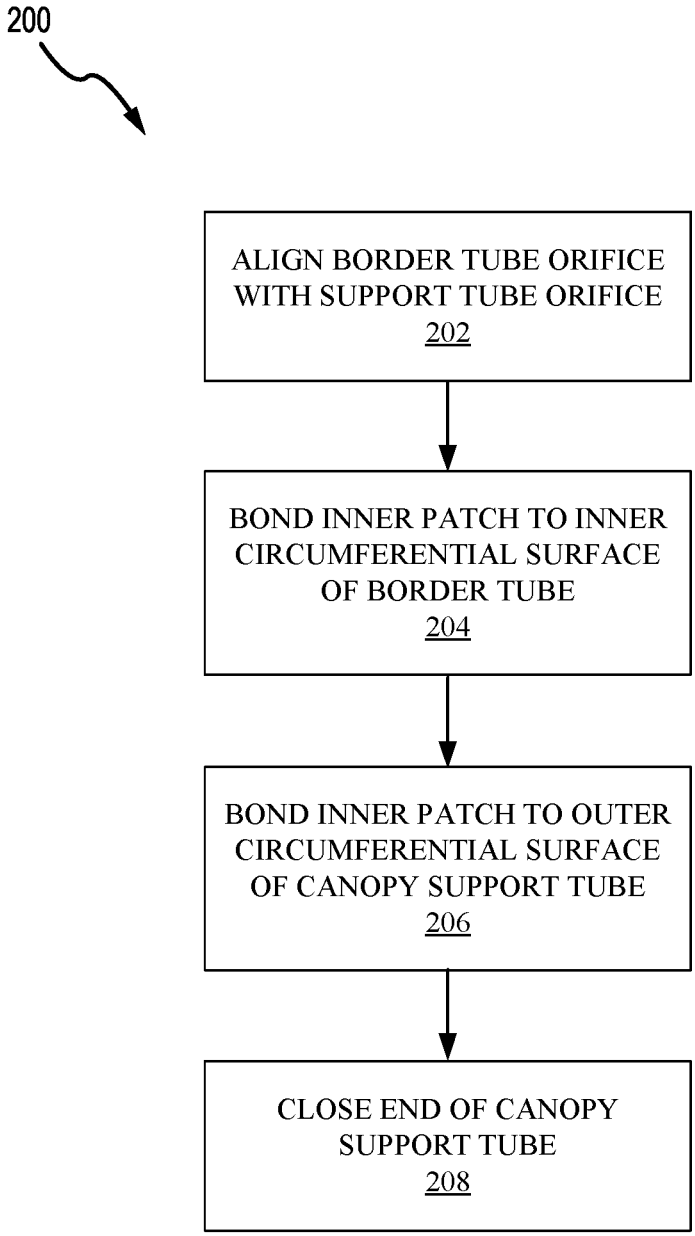
FIGS. 5A and 5B illustrate a method of forming a life raft, in accordance with various embodiments.

With reference to FIG. 5A, a method 200 of forming a life raft is illustrated. In accordance with various embodiments, the method 200 may comprise aligning a border tube orifice with a canopy support tube orifice (step 202). In various embodiments, a diameter of the canopy support tube orifice is less than a diameter of the border tube orifice. Method 200 may further include bonding an inner patch to an inner circumferential surface of the border tube (step 204) and bonding the inner patch to an outer circumferential surface of the canopy support tube (step 206). In various embodiments, the border tube orifice is located on an outer portion of the border tube, and a line tangent to the outer portion of the border tube is approximately perpendicular to a line tangent to an uppermost point of the border tube.

Figure 5B:
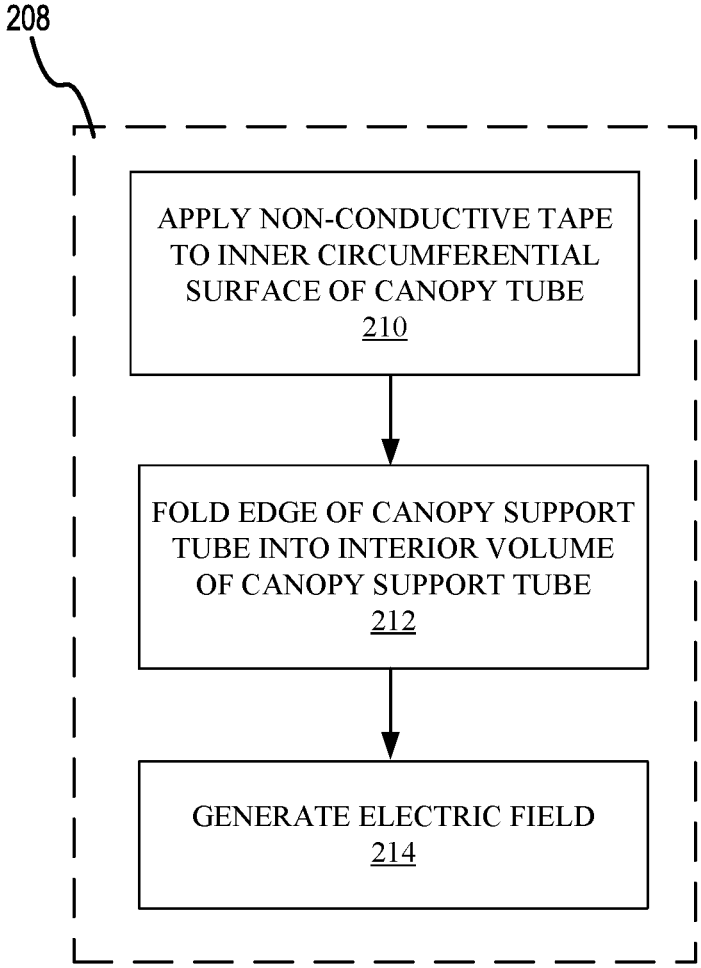

In various embodiments, method 200 may further comprise closing an end of the canopy support tube using radio frequency welding (step 208). With reference to FIG. 5B, in various embodiments, step 208 may comprise applying a non-conductive tape to an inner circumferential surface of the canopy support tube (step 210), folding an edge of the canopy support tube into an interior volume of the canopy support tube (step 212), and generating an electric field at the end of the canopy support tube (step 214). In various embodiments, step 214 includes locating the end of canopy support tube between two electrodes. In various embodiments, a clamping force may be applied during step 214.

With combined reference to FIG. 2B and FIG. 5A, in accordance with various embodiments, step 202 may include aligning border tube orifice 122 with canopy support tube orifice 120. Step 204 may include bonding inner patch 128 to inner circumferential surface 132 of the border tube 106*a*. Inner patch 128 may be located around border tube orifice 122. Step 206 may include bonding inner patch 128 to outer circumferential surface 130 of canopy support tube 110. Inner patch 128 may be located around canopy support tube orifice 120. In various embodiments, border tube orifice 122 is located on outer portion 112, with momentary reference to FIG. 1B, of border tube 106*a*. In various embodiments, step 208 may comprise closing end 150 of canopy support tube 110 using radio frequency welding.

With combined reference to FIGS. 3A, 3B, and 5B, in various embodiments, step 210 may comprise applying non-conductive tape 158 to portion 160*a* of inner circumferential surface 160 of canopy support tube 110. Step 212 may include folding edge 154 of canopy support tube 110 into interior volume 168 of canopy support tube 110. Step 214 may include generating an electric field at end 150 of canopy support tube 110. In various embodiments, step 214 may include locating end 150 of canopy support tube 110 between two electrodes 164*a*, 164*b*. In various embodiments, a clamping force may be applied to end 150 during step 214.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A life raft, comprising:

a border tube; and a canopy support tube coupled to an outer portion of the border tube, the outer portion of the border tube being approximately 90°, about a circumference of the border tube, from an uppermost point of the border tube, the canopy support tube being configured to extend in an upward direction from the outer portion of the border tube, wherein a first orifice formed in an outer circumferential surface of the canopy support tube is aligned with a second orifice formed in the outer portion of the border tube, wherein a diameter of the first orifice is less than a diameter of the second orifice, and wherein the canopy support tube includes a closed end formed by the outer circumferential surface and located generally opposite the uppermost point of the border tube.

2. The life raft of claim 1, further comprising an inner patch coupled to an inner circumferential surface of the border tube and the outer circumferential surface of the canopy support tube.

3. The life raft of claim 2, wherein an outer dimeter of the inner patch is greater than the diameter of the second orifice.

4. The life raft of claim 1, further comprising a seam tape coupled to the outer circumferential surface of the canopy support tube and an outer circumferential surface of the border tube.

5. The life raft of claim 1, wherein the closed end of the canopy support tube includes a first portion of the outer circumferential surface of the canopy support tube bonded to a second portion of the outer circumferential surface of the canopy support tube.

6. The life raft of claim 5, wherein the closed end of the canopy support tube includes a weld bonding the first portion of the outer circumferential surface of the canopy support tube to the second portion of the outer circumferential surface of the canopy support tube.

7. A life raft, comprising:

a first border tube;

a second border tube located on the first border tube; and a canopy support tube coupled to an outer portion of at least one of the first border tube or the second border tube, wherein a line tangent to the outer portion of the at least one of the first border tube or the second border tube is approximately perpendicular to a line tangent to an uppermost point of the first border tube, wherein the canopy support tube is configured to extend in an upward direction from the outer portion of the at least one of the first border tube or the second border tube, and wherein a first orifice defined by the canopy support tube is aligned with a second orifice defined by the at least one of the first border tube or the second border tube, and wherein a diameter of the first orifice is less than a diameter of the second orifice.

8. The life raft of claim 7, further comprising an inner patch coupled to an outer circumferential surface of the canopy support tube and to an inner circumferential surface of the at least one of the first border tube or the second border tube, wherein the first orifice is formed in the outer circumferential surface of the canopy support tube.

9. The life raft of claim 8, wherein an outer dimeter of the inner patch is greater than the diameter of the second orifice.

10. The life raft of claim 9, further comprising a seam tape coupled to the outer circumferential surface of the canopy support tube and an outer circumferential surface of the at least one of the first border tube or the second border tube.

11. The life raft of claim 8, wherein a closed end of the canopy support tube includes a first portion of the outer circumferential surface of the canopy support tube bonded to a second portion of the outer circumferential surface of the canopy support tube, the closed end being oriented generally away from the uppermost point of the first border tube.

12. The life raft of claim 7, further comprising a one-way valve located between a first interior volume defined by the canopy support tube and a second interior volume defined by the at least one of the first border tube or the second border tube.

13. The life raft of claim 12, wherein the one-way valve is configured allow fluid to flow from the second interior volume to the first interior volume.

14. A method of forming a life raft, comprising:

aligning a canopy support tube orifice defined by a canopy support tube with a border tube orifice defined by an outer portion of a border tube, wherein the canopy support tube is configured to extend in an upward direction from the outer portion of the border tube, and wherein the border tube orifice is formed approximately 90°, about a circumference of border tube, from an uppermost point of the border tube;

bonding an inner patch to an inner circumferential surface of the border tube; and bonding the inner patch to an outer circumferential surface of the canopy support tube.

15. The method of claim 14, wherein a diameter of the canopy support tube orifice is less than a diameter of the border tube orifice.

16. The method of claim 15, further comprising closing an end of the canopy support tube using radio frequency welding.

17. The method of claim 16, wherein closing the end of the canopy support tube using radio frequency welding comprises:

applying a non-conductive tape to the inner circumferential surface of the canopy support tube;

folding an edge of the canopy support tube into an interior volume of the canopy support tube; and generating an electric field at the end of the canopy support tube.

18. The method of claim 15, wherein a line tangent to the outer portion of the border tube is approximately perpendicular to a line tangent to the uppermost point of the border tube.

* * * * *